US007730553B2

(12) United States Patent
Benini

(10) Patent No.: US 7,730,553 B2
(45) Date of Patent: Jun. 8, 2010

(54) TORSO GARMENT

(75) Inventor: Bryon Benini, Cardiff By The Sea, CA (US)

(73) Assignee: Dye Precision, Inc., San Diego, CA (US)

( * ) Notice: Subject to any disclaimer, the term of this patent is extended or adjusted under 35 U.S.C. 154(b) by 0 days.

(21) Appl. No.: 11/452,111

(22) Filed: Jun. 13, 2006

(65) Prior Publication Data

US 2007/0000010 A1 Jan. 4, 2007

Related U.S. Application Data

(63) Continuation of application No. 10/322,170, filed on Dec. 17, 2002, now Pat. No. 7,191,470.

(51) Int. Cl.
*A41D 3/02* (2006.01)

(52) U.S. Cl. ..... 2/94

(58) Field of Classification Search ..... 2/455, 2/44, 45, 94, 95, 267, 268, 69, 102
See application file for complete search history.

(56) References Cited

U.S. PATENT DOCUMENTS

| | | | | |
|---|---|---|---|---|
| 2,302,368 | A | 11/1942 | Evans | |
| 2,948,899 | A | 8/1960 | Allen | |
| 4,353,133 | A | 10/1982 | Williams | |
| 4,669,125 | A | 6/1987 | Allen | |
| 4,882,786 | A | 11/1989 | Gross | |
| 5,014,358 | A * | 5/1991 | Matumori | 2/94 |
| 7,191,470 | B2 * | 3/2007 | Benini | 2/69 |

* cited by examiner

*Primary Examiner*—Tejash Patel
(74) *Attorney, Agent, or Firm*—Knobbe Martens Olson & Bear LLP

(57) ABSTRACT

A torso-covering garment for playing paintball having gripping areas to enable the user to grippably contact a gripping area of the garment with the butt stock of the gun. Each gripping area comprises a pliant, non-cushioning substrate. Common embodiments of the garment are shirts, jerseys, jackets, and vests. A method of playing paintball which comprises wearing the garment of the invention, and a method of fabricating the garment.

15 Claims, 5 Drawing Sheets

TORSO GARMENT

CROSS-REFERENCE TO RELATED APPLICATIONS

This is a continuation of U.S. application Ser. No. 10/322,170, filed on Dec. 17, 2002 now U.S Pat. No. 7,191,470, entitled TORSO GARMENT, which is hereby incorporated by reference in its entirety.

BACKGROUND OF THE INVENTION

1. Field of the Invention

This invention relates to a garment worn by a paintball player. The garment has a sticky surface for positioning and griping the butt stock of a gun against the garment wearer's torso.

2. Description of the Related Art

In the sport of paintball, a player wears a garment which covers the torso. When aiming and shooting, the user stabilizes the gun to improve accuracy by pressing the butt end of the paintball gun to the torso garment.

A common problem in the sport of paintball is that the butt end of a paintball gun, which is an air tank, easily slips off of the user's shoulder or chest or other portion of the torso when the user contacts the torso-covering garment with the butt end of the tank to support the gun for shooting accuracy.

The butt end of the tank typically has a round, smooth surface with a low coefficient of friction in contact with commercially available garments, such as jackets, jerseys, vests or other garment configured to cover and protect the paintball player's torso, and made of material which allows the butt end of the tank in contact with the material to easily slip or slide. This makes it difficult for the user to achieve shooting accuracy.

The present invention overcomes this problem by providing a torso-covering or torso-encircling garment which has gripping, non-skid surface on at least a portion of the garment which grippingly contacts the butt end of the tank when the player attempts to support or stabilize the gun against the torso for shooting accuracy.

SUMMARY OF THE INVENTION

The present invention provides a garment for playing paintball which is a torso-covering garment having one or more gripping areas, each of which bears a non-skid surface on one or more portions of the garment which covers at least a portion of the torso, that is, one or more of the shoulder, chest, and abdominal areas of the torso. The garment enables the paintball player to grippably contact a gripping area of the garment with the butt stock of the gun, which enhances gun stability and improves shooting accuracy. Further provided is a method of playing paintball which comprises wearing the garment of the invention while playing paintball.

The garment, which has a body side, comprises one or more flexible fabrics. The fabric has an outer side comprising one or more gripping areas. Each gripping area comprises a pliant, non-cushioning substrate. The substrate has a sticky surface for gripping engagement or contact between the butt stock of the user's gun and the gripping area. The garment covers at least a portion of the user's torso. Among common embodiments of the garment are shirts, jerseys, jackets, and vests.

DETAILED DESCRIPTION OF THE PREFERRED EMBODIMENT

Definitions

The term "garment" means an article of clothing, especially outer clothing. Garments are articles which include shirts, jerseys, jackets, and vests. Torso garments include torso-encircling articles or articles configured to be worn about all or part of a torso, attached to a torso-covering garment, or worn about another torso-covering article. In the context of this disclosure, stabilizing the butt stock against the torso or placing the butt stock against the torso should be understood to mean that the butt stock is positioned against a garment being worn over the torso.

The term "flexible" as in "flexible fabric" refers to fabric which is pliant, and which is used in the manufacture of articles of clothing.

"Sticky surface" is a term which is used herein to mean a surface which provides a gripping or adhesive force mediated by friction and/or suction against the butt stock of a gun, for example, the tank of a paintball gun. The sticky surface, disposed on an outer surface of the substrate in a gripping area of the garment, achieves gripping or gripping engagement in contact with the butt stock of a gun which has a surface that would ordinarily slip in contact with a garment which does not have a sticky or gripping surface.

A "gripping area" 15 is sticky surface together with the substrate 50. A gripping area can have a variety of planar shapes consisting of polygonal and curvilinear, and includes without limitation, substantially circular, substantially rectangular, substantially trapezoidal and substantially triangular, including square, rectangle, circle, oval, or irregular shapes, and combinations thereof as desired, for more or less effect, as desired. Gripping areas of similar shape can be reconfigured on the torso. The garment comprises one or more gripping areas. A gripping area is not padded.

Figure 1:
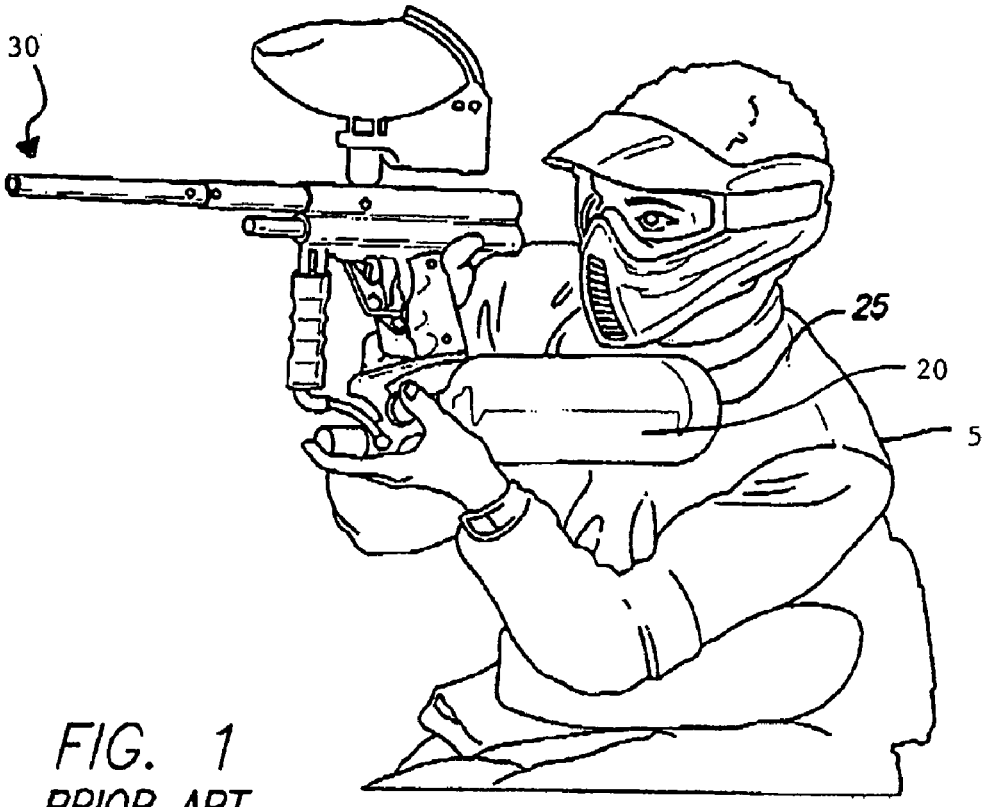
FIG. 1 PRIOR ART
FIG. 1 is an action drawing of a paintball player wearing a prior art garment, and positioning the butt stock of the paintball gun against the prior art garment covering the torso.
Figure 2:
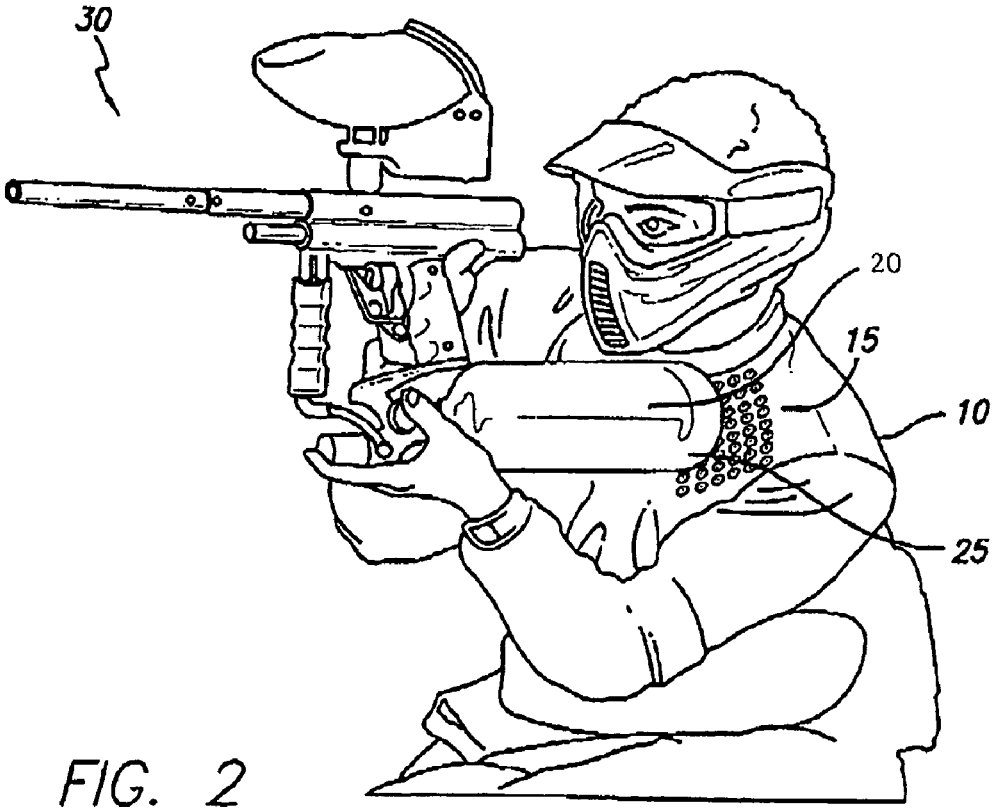
FIG. 2 is an action drawing of a paintball player wearing a torso garment of the invention. The player is aiming and/or shooting by positioning the butt stock of a paintball gun against a gripping area located in a shoulder area of the torso.

The "butt stock" 25 or "butt" of a gun refers to the portion of the gun which is held against the torso or shoulder to improve the user's aim of the gun. In a broader sense, a butt stock refers to any structure of a gun which the user places against his or her torso to stabilize the gun's position to improve aim of the gun in the act of shooting. The butt stock of a paintball gun is typically the rear end 25 of the air system tank 20, as shown in FIGS. 1 and 2. Firearms which are rifles, or shotguns which have a similar external appearance to rifles, differ from handguns in the length of the barrel and the presence of a butt stock.

As used herein, the term "body side" denotes a position relative to the user's body and does not necessarily imply that the body side is contiguous with the outer side. For example, a laminate structure may contain multiple layers on the body side and the outer side.

The term "substrate" means a flexible material of suitable strength and durability so that it can be used in the construction of the articles of the invention. In the context of the present invention, a substrate can be the fabric of the garment as well as laminates, layers, coatings, and/or additional fabric which may be disposed between the fabric and the sticky surface.

The term "non-cushioning" means not suitable for absorbing a blow. The degree of compressibility of the gripping area of the invention is not sufficient for absorbing a blow, i.e. a gripping area is not padded. Non-cushioning materials include those which are relatively non-compressible in which the degree of compressibility is insufficient to absorb a shock or blow.

The term "coating" refers to a matrix or layer of material having sticky texture and positioned on the outer surface of the substrate. "Coating" also refers to methods of applying a coating. Coating may mean disposition of sticky material within the substrate or impregnating the substrate. Coating may also refer to disposition of sticky material as a surface layer upon the substrate. Coating in the hands of one skilled in the art can be used to form continuous (i.e. uninterrupted) or protuberant gripping areas.

Figure 3:
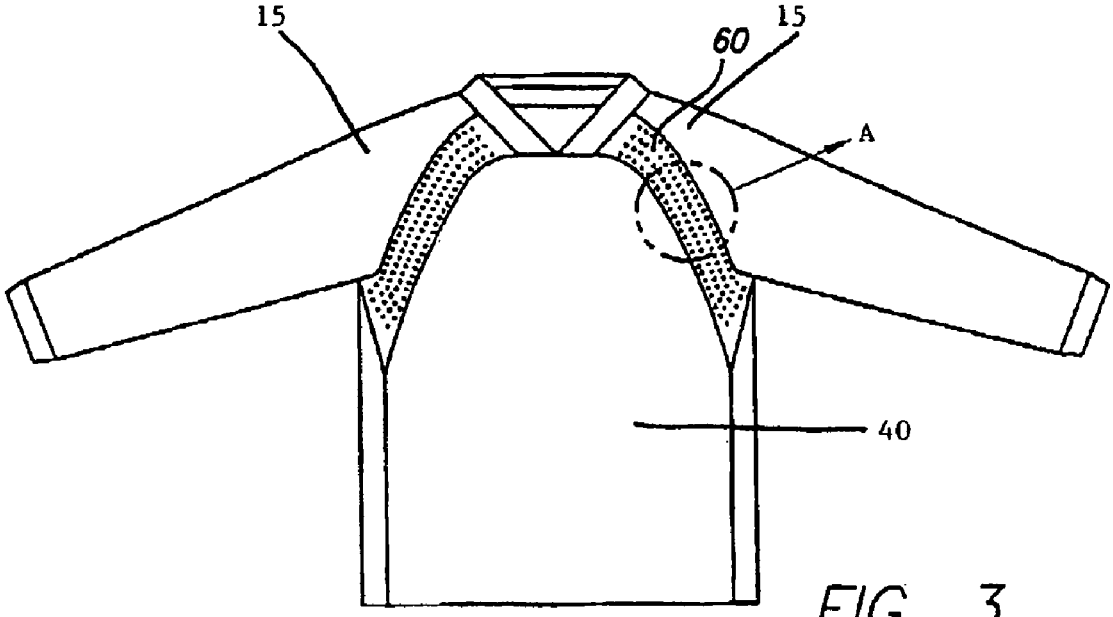
FIG. 3 is a plan view of a garment of the invention showing a gripping area of protuberances located in each shoulder area.
Figure 4:
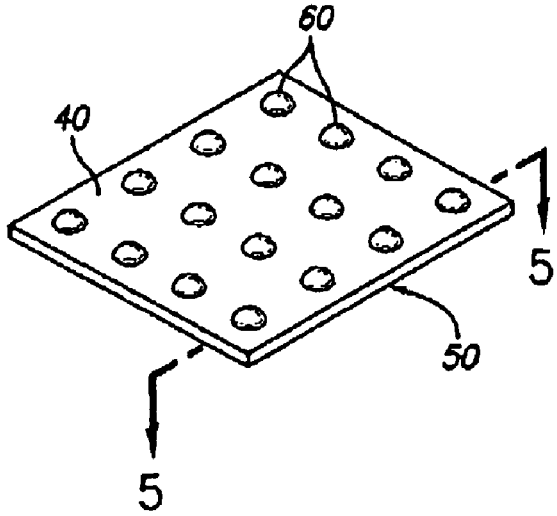
FIG. 4 is a plan view of portion A of the gripping area of FIG. 3.

Turning to the illustrations, FIG. 1 illustrates a paintball player positioning the butt end 25 of the tank 20 of a paintball gun 30 against a prior art garment 5, which has a slippery, non-grip surface which allows the butt end 25 of the tank 20 to slip or slide upon the garment. FIG. 3 is a plan view of a garment of the invention which illustrates two gripping areas 15, each contoured to the anatomy of the shoulder area against which a paintball player stabilizes the butt end of the tank for improving shooting accuracy. FIG. 4 is a cross section of a gripping area 15 in the area of FIG. 3 labeled A.

Gripping Area.

A gripping area 15 has sufficient surface area to create "gripping engagement, which means sufficient gripping friction between the butt end of the tank and the gripping area to retard or prevent slipping of the butt end of the tank over the outer side of the garment comprising a gripping area to enhance aiming the gun. A sufficient area for gripping engagement with the butt end of the tank can be as small as about 1 square inch. Preferred sizes for gripping areas range upwards from about 6 square inches.

Figure 5:
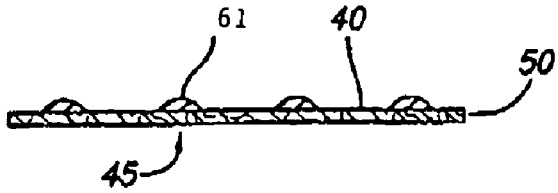
FIG. 5 is a cross section taken through line 5-5 of FIG. 4.
Figure 6:
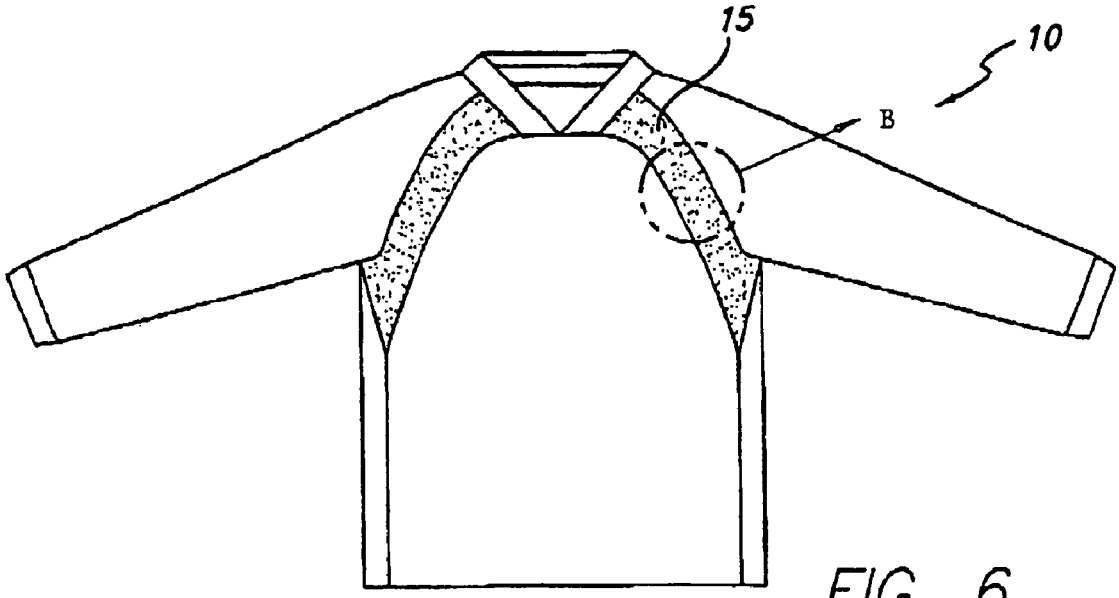
FIG. 6 is a plan view of a garment of the invention showing a gripping area of continuous, uninterrupted sticky material in each shoulder area.
Figure 7:
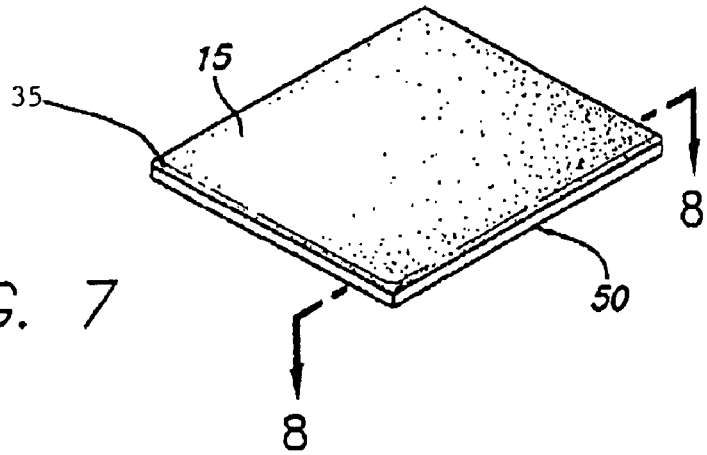
FIG. 7 is a plan view of portion B of the gripping area of FIG. 6.
Figure 8:
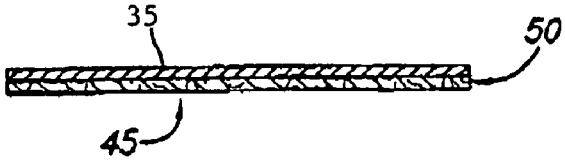
FIG. 8 is a cross section taken through line 8-8 of FIG. 7.
Figure 9:
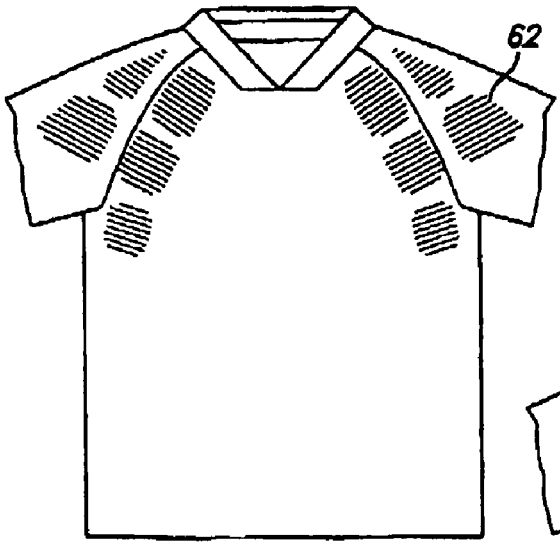
FIGS. 9-11 show gripping areas formed from protuberances configured as lines.
Figure 10:
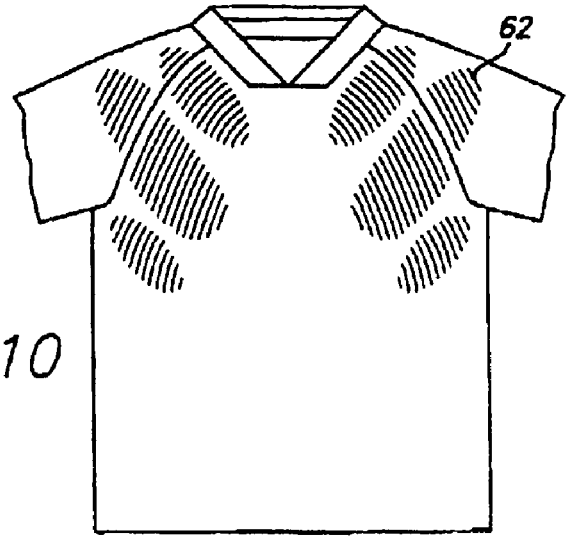

In embodiments of the invention, a gripping area has an uninterrupted or continuous sticky surface, as shown in FIG. 6. Alternatively, a gripping area can be formed from a plurality of sticky surfaces configured in a gripping area. As shown in FIGS. 3-5, a gripping area comprises a plurality of sticky protuberances 60 formed from a non-skid or sticky material disposed on the substrate 50 of the gripping area 15. Examples of sticky material are set forth below, and include silicone. To form a gripping area with sufficient frictional or sticky quality for a user to achieve gripping engagement of the butt stock of a gun in contact with a gripping area, a sufficient number of sticky protuberances are spaced or patterned sufficiently close together on the substrate to collectively provide gripping engagement between the plurality of sticky protuberances and the butt stock of the gun. A protuberance is any volumetric shape that juts, bulges or otherwise projects outward from the substrate in a gripping area.

FIGS. 3, 4, 5 show protuberances 60 shaped as hillocks 61 and lines 62 in any pattern or combination of shapes and patterns so long as collectively they provide sufficient friction to grippingly engage the butt stock of a gun. Other planar shapes and patterns are equally attainable without deviating from an object of the invention to provide sufficient friction to grippingly engage the butt stock. A protuberance could, in cross-section, be substantially circular, substantially rectangular, substantially trapezoidal or substantially triangular.

Although the desired density of protuberances is variable, it may be practically undesirable for some embodiments to have a single protuberance which lacks sufficient grippability to grip the butt end of the gun. On the other extreme, the stickiness applied to the butt stock is delivered vis a vis the end points of the protuberances and divided among these points. Therefore, the more protuberances in a gripping area, the gripping effect of the end points is enhanced and less pressure or force is required to grippingly engage the butt stock to the garment.

The garment of the invention is not restricted in scope to the disclosed patterns of gripping areas or patterns of protuberances of gripping areas. Achieving gripping engagement is inherent in a gripping area's surface area whether comprised of a continuous sticky surface and/or discrete sticky surfaces in the form of protuberances as described above.

In preferred embodiments, protuberances should have a substantially uniform height dimension to uniformly apply gripping friction to the butt stock. Protuberances of varying height may employed in certain applications and are within the scope of this invention. A combination of shorter and longer protuberances may be desirable to provide certain gripping characteristics.

Figure 11:
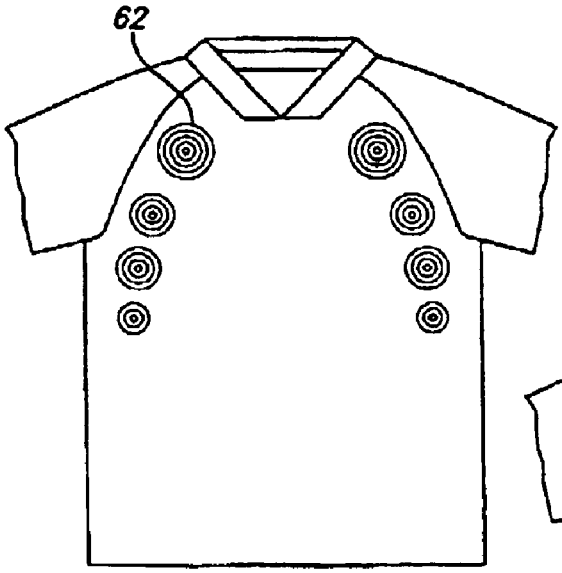
Figure 12:
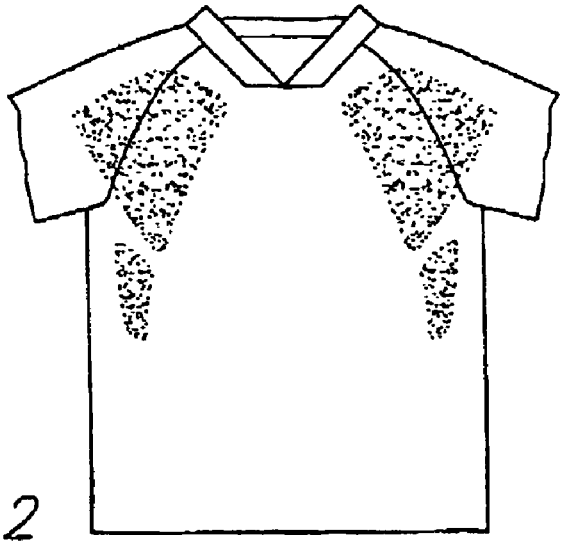
FIG. 12 shows a gripping area formed from a random arrangement of hillocks within each gripping area.

Protuberances may be arranged on a substrate in any manner. They can be arranged in a random manner or uniformly. As shown in FIG. 11, protuberances are arranged in concentric rings.

Operation of the Garment.

In use, when a gripping area 15 of the garment is engaged with the butt stock 25, the sticky surface (e.g. area A of FIG. 3; area B of FIG. 4) grippingly engages the butt stock. The sticky surface of the gripping area of the garment allows the user to have more control of aim during the entire shooting process. In use with a paintball gun, the sticky surface grippingly engages the continuously curving tank surface. This is advantageous over existing garments which have outer surfaces which are not sticky and which allow a butt stock to slip, slide, or otherwise not grippingly engage the outer surface of the garment, making aim more difficult to control. During the shooting process, when the user brings the butt stock of a rifle or the tank of a paintball gun against the torso to stabilize the gun, the gripping area in that section of the torso keeps the user in closer control of the aim of the gun, and assists in more accurate handling and positioning of the gun during the shooting movements. The degree of stickiness of the sticky surface provides for a relatively smooth release when the user disengages the butt stock of, for example, the tank, from the gripping area. As the user releases the pressure of the tank against a gripping area, the force of the tank leaving the surface of the gripping area overcomes the gripping attachment and aim-enhancing force of the sticky surface.

Torso locations for a gripping area include one or both shoulder areas (see, for example, FIG. 2, illustrating a gripping area on one shoulder area). Other areas include abdominal area and chest. The grip-enhancing gripping areas are positioned at all or some of the areas on the garment that contact the butt stock when the user positions the gun against the torso to improve aim. Although not preferred, the outer side of the garment and the gripping area may be coextensive.

General Construction of the Garment

The gripping area of the garment comprises a pliant or flexible substrate 50, which is non-cushioning and which has a sticky surface 35 (or collectively protuberances 60) for gripping engagement with the butt stock.

Structure of Substrate.

A flexible fabric substrate is formed of natural and/or synthetic fibers, which may be woven or non-woven and spun of filament yarn of the desired length. Cotton, polyester, nylon and rayon are typical materials which may be used as fibers or yams in this invention. For example, a substrate is a woven fabric typically used for making an athletic jersey. Flexible fabrics suitable for forming a gripping area include, but are not restricted to textiles and fabrics manufactured or supplied by DuPont, Schoeller, Top Value Fabrics, Dow, Formosa, Brookwood, John King, and the like.

A flexible fabric may consist of non-woven materials including, but not restricted to, neoprene, rubber, leather, cordura™ Naugahyde™, PVC, polyethylene, polypropylene, polyurethane, various leathers, and vinyl. Representative fibrous materials may be comprised of wool, polyesters, polyamides, such as Kevlar or Nomex which are products of DuPont, polyolefins, such as polypropylene and polyethylene and copolymers of acrylic acid, such as polyacrylonitrile. If a knitted web substrate is used, it may be cotton, polyester, or a cotton-polyester blend. If it is woven, it may be nylon or cotton. The material forming the sticky surface of the laminate, in accordance herewith, as discussed above, includes polyurethane, polyvinyl chloride, acrylonitrile, natural or synthetic rubber.

Accordingly, the invention includes a gripping surface substrate which may be a fabric web comprised of a non-woven fibrous web, a knitted fabric web such as knitted jersey, or a woven fabric, for example. The substrate may be comprised of natural or synthetic fibers or blends thereof including, for example, polyester, or a polyester-cotton blend. Preferably the gripping surface is flexible and has a degree of texture or stickiness as desired for providing a gripping surface which is non-cushioning.

Application of Sticky Material to Substrate

A sticky surface is formed on a substrate by disposing sticky matrix material on the outer side of the substrate or fabric in an amount sufficient to impart the desired grippability or stickiness for gripping engagement of the butt stock to the outer side of the garment.

The fabric substrate is spread coated, calendared, dipped or otherwise contacted with a sticky matrix material. Suitable matrix materials include thermoplastic resins, thermosetting resins, polyurethanes, or natural or synthetic elastomers. PVC and other polyolefins are suitable thermoplastic resins, while preferred polyurethanes are disclosed in U.S. Pat. Nos. 5,001,208 and 5,013,811, which are each expressly incorporated herein by reference thereto. U.S. Pat. No. 6,099,936, incorporated herein by reference, discloses a method for forming a sticky surface on a fabric by pressure-fit in which a gum may be impregnated into the textile of the fabric without the use of any adhesive agent, or may be adhered by an adhesive agent. Furthermore, the fabric may be knitted, natural gum, or synthetic rubber. Various materials, such as perfluoroelastomer rubber, nitrile rubber, silicone rubber, neoprene, vinyl, natural rubber and others, are typically used. Other materials having similar sticky qualities are equally usable to achieve the objects of the invention.

In all cases, enough sticky material is applied to the substrate to over a sufficiently large area of the garment to form one or more gripping areas with surface having the qualities of gripping or sticky engagement with the butt stock, or to impart increased gripping properties to the substrate. As will be appreciated by practitioners-in-the-art, various polymeric coatings and methods for apply the same may be used, selected from a wide variety of polymers to form a sticky surface on the substrate. These methods include, but are not limited to, fusing, heat transfer, weaving, adhesive embossing, laminating, raised inks. The sticky surface can be made of a plurality of layers of the same or different materials.

One skilled in the art is aware of a number of techniques for applying sticky matrix materials in liquid form (i.e., by a solvent solution or a latex dispersion) to a fabric substrate. These methods include silk screening, sonic welding, heat pressure or iron-on.

Other embodiments of the garment involve gripping areas comprising double-back or double-sided adhesive sheets or iron-on sticky or tacky surfaces on the outer side of the garment.

Laminates or Composites

The garment of the invention includes gripping areas which comprise a laminate in which the outer side is a sticky surface for gripping engagement between the butt stock and the gripping area surface. Typically, such gripping areas are manufactured by a variety of methods for producing a laminate useful in the manufacture of wearing apparel. (U.S. Pat. No. 4,589,940, incorporated by reference) and to laminates wherein a flexible gripping surface is required. It is appreciated that those of skill in the art possess techniques for controlling the degree of stickiness of such laminate gripping surfaces.

An embodiment of the gripping area of the invention includes substrate which is flexible, fabric and which is embossed or imprinted. Methods for making embossed fabric substrates are well known in the art, and include that disclosed in U.S. Pat. No. 6,050,965, hereby incorporated by reference.

The sticky surface can be directly attached to the outer side of a garment or to a piece of flexible fabric by adhesive, sewing, molding, spraying, silk screening, coating, sonic welding, or combinations thereof as desired. Techniques for directly attaching a sticky surface to a flexible fabric are well-known to those of ordinary skill in protective garment manufacturing.

By way of illustration but not limitation, methods of fabricating the garment of the invention include (a) a substrate in the form of the garment absent the gripping areas onto which a sticky surface is applied or secured as a coating or laminate using the techniques described herein thereby forming the garment of the invention; (b) a substrate for incorporation into or onto the garment, onto which sticky surface is applied or secured by sewing or as a coating or laminate using the techniques described herein to form a gripping area, the gripping area either whole or subdivided into pieces, and then secured into or onto the remaining substrate of the garment by sewing, glue, cement, screw, heat bond, nut and bolt arrangement, rivets, velcro strips or other hook and loop type materials, buttons, snap fasteners, and the like, thereby forming the garment of the invention; (c) combinations of (a) and (b).

The substrate which is incorporated into the garment may be formed into fabric pieces prior to the application of a sticky surface, or they may be formed from a previously prepared laminate of the sticky surface and a substrate. Many different customized or mass production techniques are used in the formulation of articles (i.e. the garment of the invention) in accordance with this invention. Obviously a variety of mass production techniques may be applied making the products of the invention here highly advantageous commercially.

Figure 13:
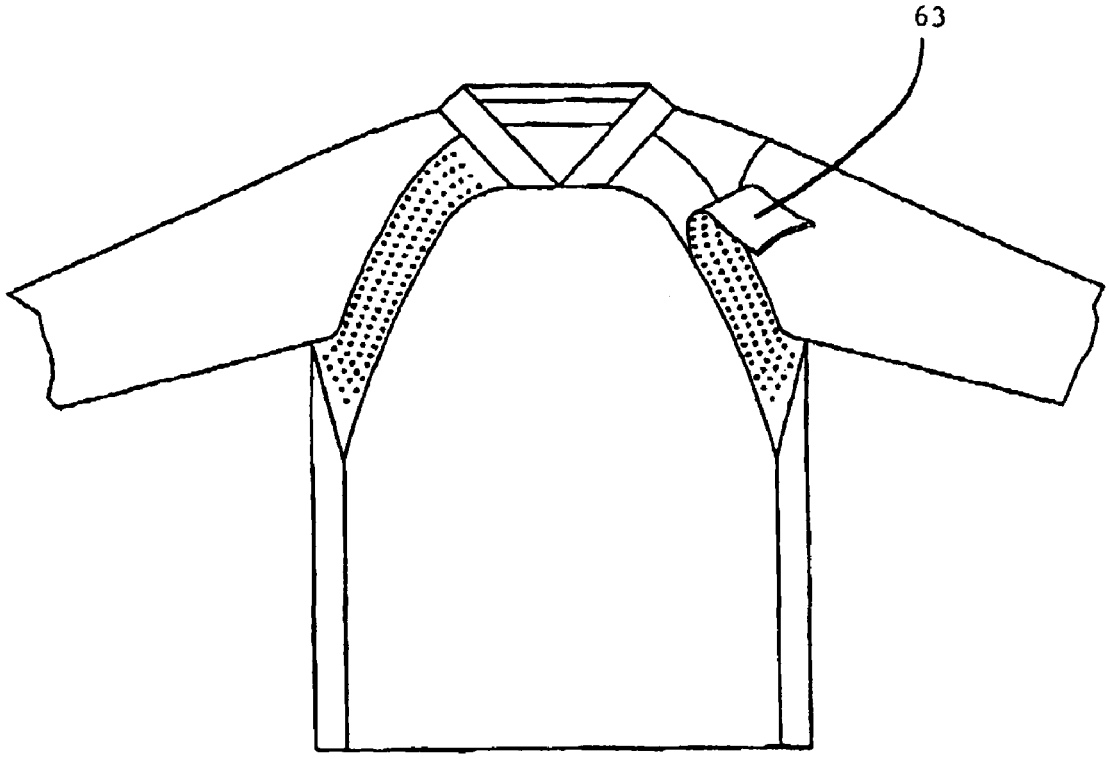
FIG. 13 shows gripping areas which are patches attached to a shoulder area of the garment.

FIG. 13 shows a garment that has gripping areas shaped formed as patches 63 positioned at selected locations on the frontal torso of the garment. The patches 63 can be attached with a removable attachment material, such as hook and loop material (e.g. Velcro™)) appropriately fixed to the garment and the patch. The attachment material should be secure enough to keep the sticky material or grip-enhancing material from being removed from the garment when the butt stock is released from the garment. The patches can have a variety of shapes, including squares, rectangles, circles, ovals, or irregular shapes, as desired, for more or less effect, as desired. Patches of differing shape can be used for different applications, or patches of similar shape can be reconfigured on the torso.

While the sticky material of the gripping area allows the user to have greater control over the gripped object, i.e. the butt stock, it should be understood that the gripping area does not help cushion the user's torso from the force of the blow of the butt end of the tank against the torso.

It is envisioned that the gripping area will enhance gripping of a variety of shapes of a butt stock, such as the air system tank of a paintball gun, which is typically a cylindrically-shaped object, as well as to other irregularly shaped objects. As long as the shape of butt stock and the surface of the butt stock allow at least a gripping force to be developed between the gripping area and the surface of the butt stock, the grip-enhancing sticky surface will improve aim-control. The aim-control enhancing quality of the gripping area works when used to enhance the control via friction or suction on a relatively smooth surface, such as plastic, polished leather, metals, or the like.

What is claimed is:

1. An upper torso garment for stabilizing a curved rear portion of a gas system tank of a paintball marker, the upper torso garment comprising:

a flexible fabric;

a neck opening;

at least one arm opening; and a plurality of tacky protrusions disposed in one or more gripping regions on the flexible fabric in at least a lower shoulder area extending between a side portion of the neck opening and a lowermost portion of the at least one arm opening of at least one of a left and right side of the upper torso garment, the plurality of tacky protrusions being fixedly attached to the garment and spaced apart so as to expose at least a portion of the flexible fabric between the tacky protrusions and provide flexibility in the gripping regions, the plurality of tacky protrusions being configured to grip the curved rear portion of the gas system tank when the rear portion is placed against the garment.

2. The garment of claim 1, wherein the garment comprises a plurality of fabrics.

3. The garment of claim 1, wherein the plurality of protrusions is disposed in both the left and right sides of the garment.

4. The garment of claim 1, wherein the plurality of protrusions includes protrusions having varying heights.

5. The garment of claim 1, wherein the plurality of protrusions includes protrusions having varying cross-sectional shapes.

6. The garment of claim 1, wherein the garment is a shirt.

7. The garment of claim 1, wherein the garment is a jersey.

8. A garment for gripping a rear portion of a gas tank of a paintball marker, the garment comprising:

a flexible material configured to cover at least a portion of a user's upper torso;

a neck opening; and a plurality of protrusions disposed on the flexible material and arranged to form a gripping region integral with the garment, the protrusions being disposed so that at least a portion of the flexible material is exposed between the protrusions, the gripping region being positioned in at least a lower shoulder area below a horizontal line tangent to a lowermost portion of the neck opening of the garment and on at least one of a left and right side of the garment so as to contact the rear portion of the gas tank when the gas tank is placed against the garment.

9. The garment of claim 8, wherein the plurality of protrusions forms a shape selected from the group consisting of polygonal, curvilinear, and combinations thereof.

10. The garment of claim 8, wherein the plurality of protrusions is disposed in both the left and right sides of the garment.

11. The garment of claim 8, wherein the plurality of protrusions includes protrusions having varying cross-sectional shapes.

12. The garment of claim 8, wherein the plurality of protrusions includes protrusions having a substantially linear shape.

13. An upper torso garment for stabilizing a paintball marker having a gas tank, the garment comprising:

a torso portion;

a neck opening in the torso portion;

at least one sleeve connected to the torso portion;

a flexible fabric having a receiving area in at least one of a lower right shoulder area and a lower left shoulder area of the upper torso garment, the lower right shoulder area and lower left shoulder areas extending between the neck opening and an intersection of the at least one sleeve with the torso portion; and a plurality of protuberances disposed on the flexible fabric and in the receiving area, the protuberances being permanently attached to the garment and spaced apart to expose the flexible fabric in at least a portion of the receiving area so as to conform to and contact the gas tank, the plurality of protuberances having contact surfaces so as to form a bond with the gas tank, the bonds providing an adhesive force in at least a direction that is substantially parallel to the receiving area when the gas tank is in contact with the plurality of protuberances.

14. The garment of claim 13, wherein a shape of the receiving area is a parallelogram.

15. The garment of claim 13, wherein the contact surface is disposed substantially at a center of the protuberance.

* * * * *

UNITED STATES PATENT AND TRADEMARK OFFICE

CERTIFICATE OF CORRECTION

PATENT NO. : 7,730,553 B2
APPLICATION NO. : 11/452111
DATED : June 8, 2010
INVENTOR(S) : Bryon Benini It is certified that error appears in the above-identified patent and that said Letters Patent is hereby corrected as shown below:

Column 5, Line 23 (Approx.), please delete "yams" and insert --yarns--.

Signed and Sealed this

Sixteenth Day of November, 2010

David J. Kappos

David J. Kappos
*Director of the United States Patent and Trademark Office*